US009376197B1

(12) United States Patent
Wood

(10) Patent No.: US 9,376,197 B1
(45) Date of Patent: Jun. 28, 2016

(54) SWIVEL BRACKET FOR TROLLING MOTOR FOOT CONTROLLER

(71) Applicant: Timmy Wood, Monticello, AR (US)

(72) Inventor: Timmy Wood, Monticello, AR (US)

( * ) Notice: Subject to any disclaimer, the term of this patent is extended or adjusted under 35 U.S.C. 154(b) by 0 days.

(21) Appl. No.: 14/469,081

(22) Filed: Aug. 26, 2014

Related U.S. Application Data

(60) Provisional application No. 61/942,759, filed on Feb. 21, 2014.

(51) Int. Cl.
*A47B 96/06* (2006.01)
*B63H 21/21* (2006.01)
*F16M 13/02* (2006.01)

(52) U.S. Cl.
CPC ..... *B63H 21/213* (2013.01); *F16M 13/022* (2013.01)

(58) Field of Classification Search
CPC ..... B63H 21/213; F16M 13/022
See application file for complete search history.

(56) References Cited

U.S. PATENT DOCUMENTS

| | | | | |
|---|---|---|---|---|
| 2,968,273 | A | 1/1961 | Corbett et al. | |
| 4,597,356 | A * | 7/1986 | McCaghren | B63B 29/04 114/153 |
| 4,722,706 | A | 2/1988 | Young | |
| 4,964,820 | A | 10/1990 | Rayborn | |
| 5,052,325 | A | 10/1991 | Rhines | |
| 5,152,703 | A | 10/1992 | Clement | |
| 6,468,117 | B1 | 10/2002 | Healey | |
| 6,758,705 | B1 | 7/2004 | Bechtel et al. | |
| 7,101,234 | B2 | 9/2006 | Clouse | |
| 8,641,355 | B2 * | 2/2014 | Pawlak | B60P 1/548 212/180 |
| 8,720,845 | B2 * | 5/2014 | Courbon | B60R 1/0612 16/343 |

* cited by examiner

*Primary Examiner* — Amy Sterling
(74) *Attorney, Agent, or Firm* — Robert C Montgomery; Montgomery Patent & Design, LLC

(57) ABSTRACT

A bracket for a foot control switch of a trolling motor includes a mounting assembly configured to be removably connected to a substantially cylindrical pedestal of a boat seat, and a switch platform assembly removably connected to the mounting assembly, the switch platform assembly being configured for removable attachment of the foot control switch.

11 Claims, 3 Drawing Sheets

SWIVEL BRACKET FOR TROLLING MOTOR FOOT CONTROLLER

RELATED APPLICATIONS

The present invention was first described in and claims the benefit of U.S. Provisional Application No. 61/942,759, filed Feb. 21, 2014, the entire disclosures of which are incorporated herein by reference.

FIELD OF THE INVENTION

The present invention relates generally to trolling motors and, more particularly, to a swivel bracket for a trolling motor foot controller.

BACKGROUND OF THE INVENTION

Fishing is a hobby-type sport that is enjoyed around the world, by the young and old alike. After the fishing rod and tackle box, the fishing boat is the next most common piece of apparatus used in fishing. Another common piece of equipment used while fishing from a boat is a trolling motor. Such a motor allows the fisherman to almost silently move along a lake while fishing.

These motors are typically controlled by a foot mounted switch that sits in the bottom of the boat. However, such switches tend to slide around and become misplaced. When the fisherman needs to activate the switch, they must spend time to locate it, and then place it in the proper location where it can be easily accessed. Unfortunately, any acceleration or movement causes the switch to move, thus repeating the entire process in a frustrating manner.

Accordingly, there exists a need for a means by which a foot control switch for a trolling motor can be secured to a fixed location, but remain easily accessible for use.

SUMMARY OF THE INVENTION

The inventor has recognized the aforementioned inherent problems and lack in the art and observed that there is a need for a bracket for a trolling motor controller that provides a fishermen the ability to easily find and use a trolling motor foot switch, in a manner that is quick, easy, and effective. The development of the present invention, which will be described in greater detail herein, substantially departs from conventional solutions to fulfill this need.

In one (1) embodiment, the disclosed bracket for a foot control switch of a trolling motor includes a mounting assembly configured to be removably connected to a substantially cylindrical pedestal of a boat seat, and a switch platform assembly removably connected to the mounting assembly, the switch platform assembly being configured for removable attachment of the foot control switch.

In another embodiment, the disclosed bracket for a foot control switch of a trolling motor includes a mounting assembly. The mounting assembly includes a first plate including a first end configured to be removably connected to a substantially cylindrical pedestal of a boat seat and an opposed second end. The mounting assembly includes a first plate extension extending from the second end of the first plate. The mounting assembly includes a channel feature disposed at the first plate extension. The bracket includes a switching platform assembly connected to the mounting assembly. The switching platform assembly includes a second plate configured for attachment of the foot control switch. The second plate includes a first end and an opposed second end. The switching platform assembly includes a second plate extension extending from the second end of the second plate. The switching platform assembly includes a slide plate disposed at the second plate extension. The channel feature receives the slide plate to removably connect the switching platform assembly to the mounting assembly.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
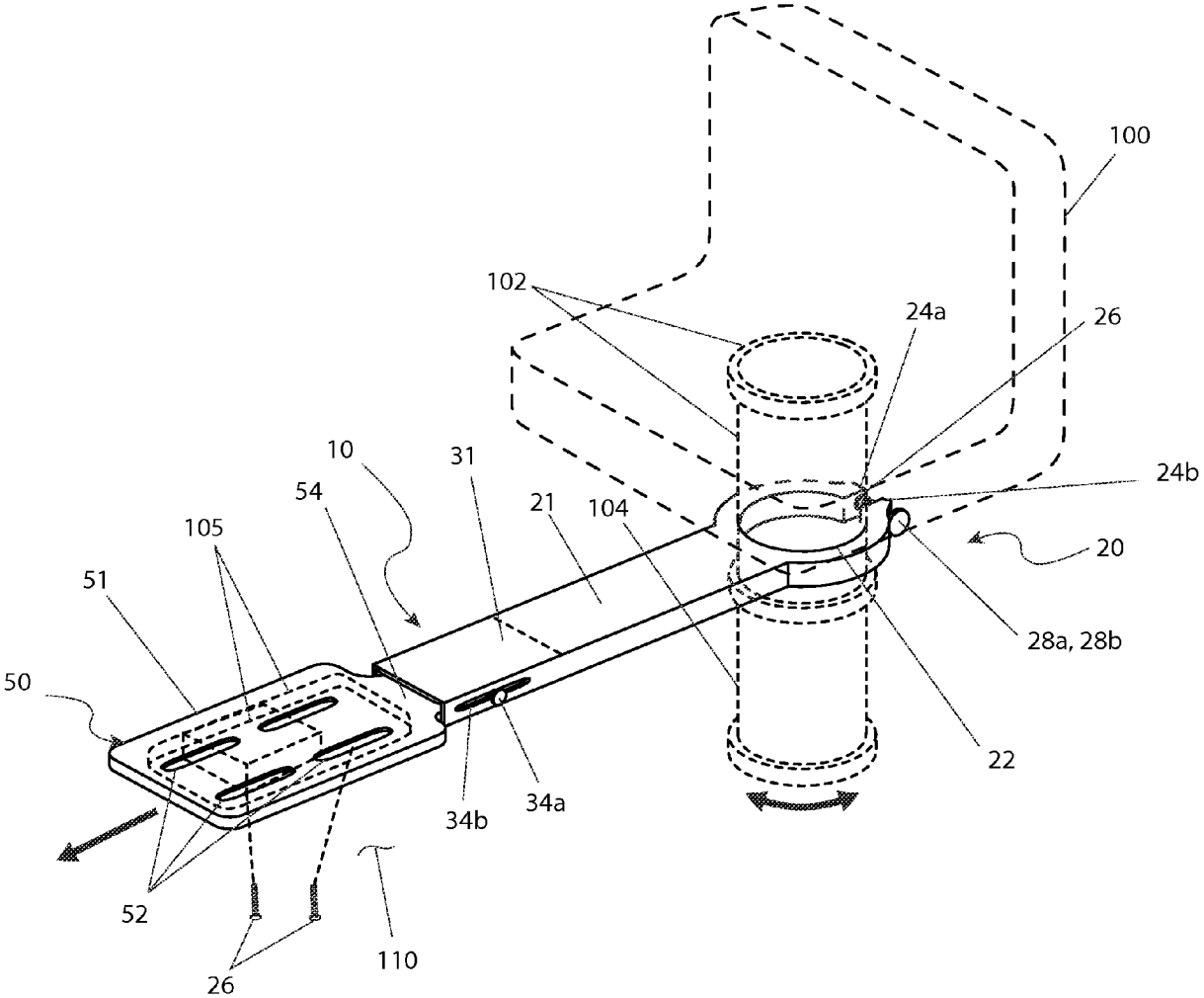
FIG. 1 is an environmental perspective view of one embodiment of the disclosed bracket for a trolling motor controller.

10 bracket for a trolling motor controller
20 mounting assembly
21 first plate
22 clamping aperture
24*a* first clamping ear
24*b* second clamping ear
26 fastener
27 split
28*a* clamping knob
28*b* clamping knob aperture
31 first plate extension
32 channel feature
34*a* positioning knob
34*b* first slotted hole
50 switch platform assembly
51*a* second plate
51*b* second plate rim
52 second slotted hole
54 second plate extension
56 slide plate
58 positioning knob aperture
70 bracket for a trolling motor controller
72 first plate
73 aperture
74 flanged bushing
100 boat seat
102 pedestal
105 foot control switch
110 deck surface

DETAILED DESCRIPTION OF THE INVENTION

Figure 2:
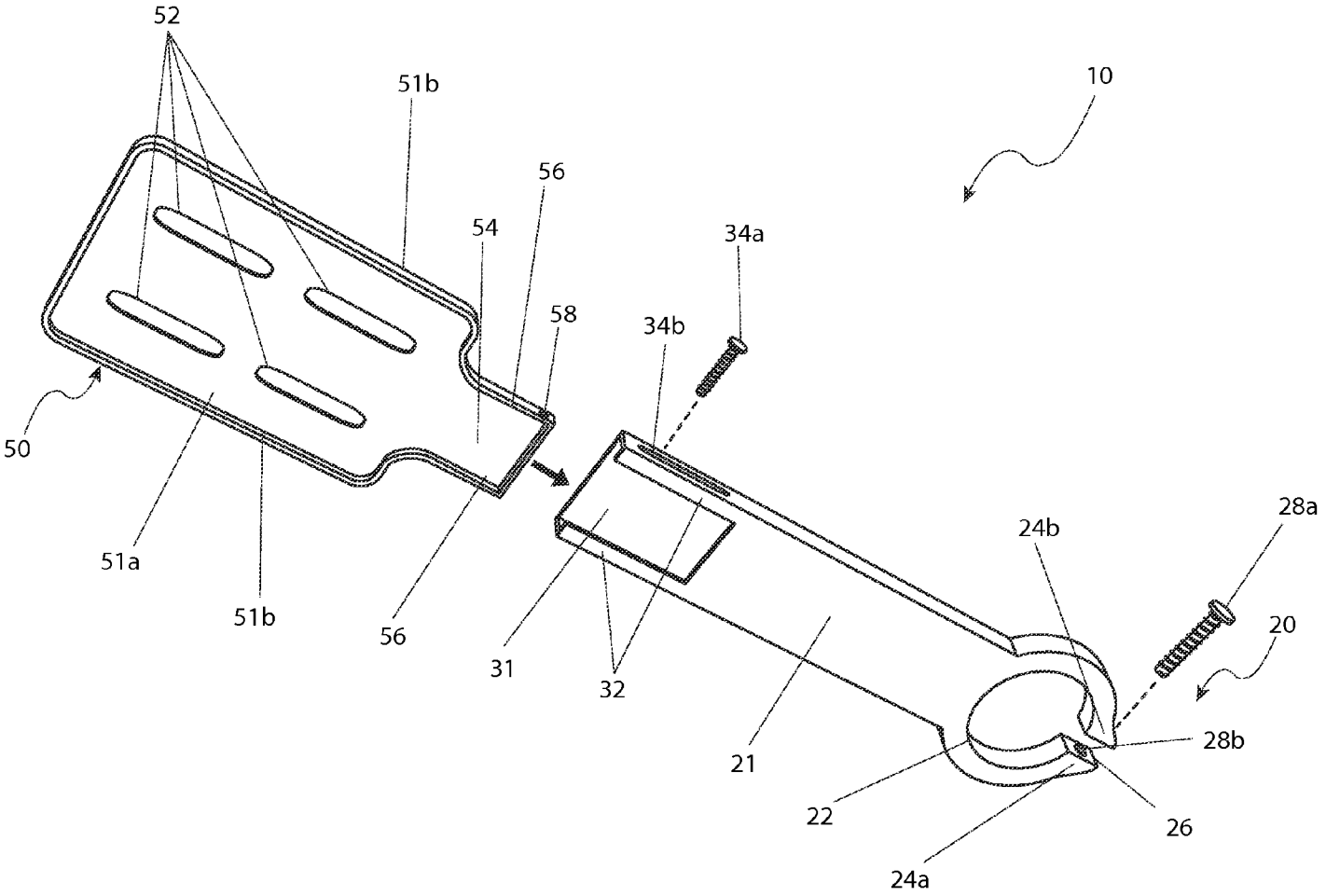
FIG. 2 is an exploded perspective view of the bracket for a trolling motor controller; and, FIG. 3 is an exploded perspective view of another embodiment of the disclosed bracket for a trolling motor controller.
Figure 3:
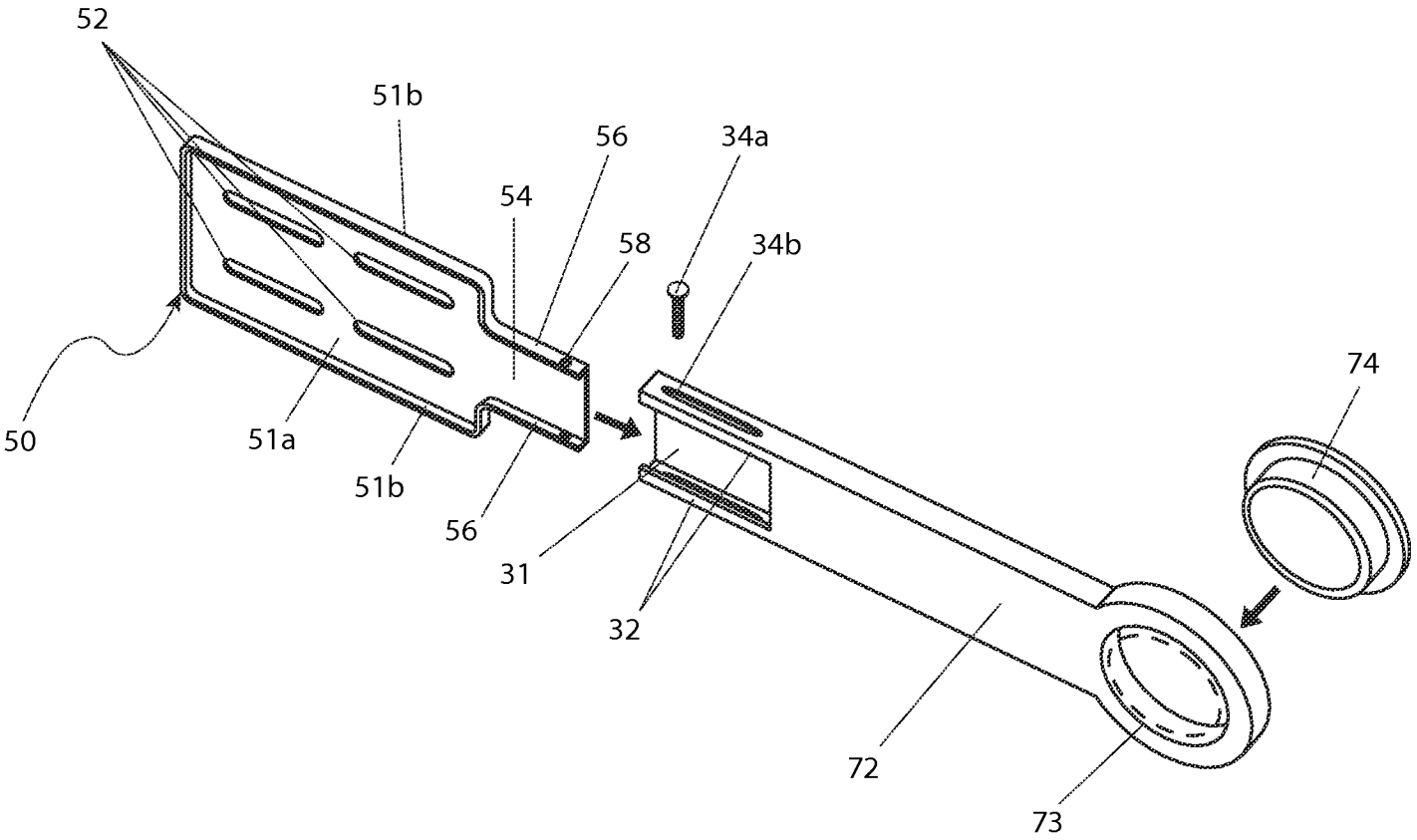

In accordance with the invention, the best mode is presented in terms of a one or more of the disclosed embodiments, herein depicted within FIGS. 1 through 3. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-3, disclosing a bracket for a trolling motor controller (herein described as the "apparatus") 10, where like reference numerals represent similar or like parts. The apparatus 10 provides a mounting bracket for positioning a foot control switch 105 used with a trolling motor upon an existing fishing boat.

Referring to FIG. 1, one (1) embodiment of the disclosed apparatus 10 includes a mounting assembly 20 having a centrally-located clamping aperture 22 designed to provide removable mounting of the apparatus 10 to a cylindrical pedestal 102 of a swivel-type boat seat 100, such as the type permanently mounted to a deck surface 110 of a watercraft (not shown). This manner of attachment enables the mounting assembly 20 of the apparatus 10 to freely rotate around the pedestal 102. This arrangement enables rotation of the apparatus 10, thereby providing easy access to the foot controlled switch 105 that is to be mounted to a switch platform assembly 50 of the apparatus 10.

Access to the foot controlled switch 105 is envisioned to enable convenient operation of a corresponding trolling motor (not shown) in a conventional manner. When installed, the apparatus 10 and mounted foot control switch 105 lie upon the deck surface 110 and can spin around the seat pedestal 102 in a three-hundred sixty degree (360°) circle, being reachable whether a user is standing on the deck surface 110 or sitting in the boat seat 100. The foot control switch 105 is to be stationarily mounted to the switch platform assembly 50 to prevent displacement of the foot control switch 105 due to sudden acceleration or movement of the boat.

It is envisioned that the apparatus 10 would be provided as an integral component of new trolling motors or may be introduced as an add-on kit for installation upon existing boat seats 100.

Referring to FIG. 2, the apparatus 10 is approximately two feet (2 ft.) in length and six inches (6 in.) in width and includes the mounting assembly 20 and the switch platform assembly 50. The apparatus 10 is envisioned being made using a corrosion-resistant metal material such as polished aluminum, stainless steel, chrome-plated steel, or the like.

The mounting assembly 20 includes a horizontal first plate 21 and a centrally located clamping aperture 22 at one (1) (e.g., a first) end. The clamping aperture 22 includes a first clamping ear 24*a* and a mirror-image second clamping ear 24*b* opposing the first clamping ear 24*a*. The clamping ears 24*a*, 24*b* are separated by a split feature 27 configured to allow closure of the clamping aperture 22 around the pedestal 102.

The split feature 27 is tightened via a clamping knob 28*a* and corresponding clamping knob aperture 28*b* of the mounting assembly 20. The clamping knob aperture 28*b* passes through the clamping ears 24*a*, 24*b* along a common axis. The clamping knob 28*a* is envisioned to be tightened to enable smooth rotation of the apparatus 10 in a three-hundred sixty degree (360°) circle around the pedestal 102. However, the clamping knob 28*a* may be tightened to close the split feature 27 to maintain the apparatus 10 at a fixed position, if desired.

The switch platform assembly 50 provides a mounting means to a foot control switch 105 (FIG. 1) and also includes a horizontal second plate 51*a* having a downwardly extending second plate rim 51*b* along three (3) sides. The second plate rim 51*b* provides both decorative and structural functions to the second plate 51*a*.

The mounting plate assembly 20 and switch platform assembly 50 provide slidable and linearly-adjustable attachment to each other to provide selective relative positioning of the foot control switch 105 with regards to the pedestal 102.

An opposing (e.g., second) end of the first plate 21 extends perpendicularly outward toward the second plate 51*a* in a coplanar manner, transitioning into a rectangular first plate extension 31. In a similar manner, the second plate 51*a* of the switch platform assembly 50 includes a coplanar and perpendicularly extending second plate extension 54. The first plate extension 31 and second plate extension 54 slidingly engage each other via a pair of channel features 32 and a pair of inserting slide plates 56, respectively.

The switch platform assembly 50 may be secured at a desired position relative to the mounting plate assembly 20 by tightening a positioning knob 34*a*. The positioning knob 34*a* provides a stud-knob device that passes through a first slotted hole 34*b* formed through at least one (1) channel feature 32 of the first plate extension 31, and in turn threadingly engages a threaded positioning knob aperture 58 of a correspondingly positioned slide plate 56 of the second plate extension 54.

The second plate 51*a* also provides a plurality of second slotted holes 52 along a top surface that allow for the mounting of various foot control switches 105 thereto. The foot control switch 105 is to be mounted to the second plate 51*a* by inserting a plurality of fasteners 26 upwardly through the corresponding second slotted holes 52 formed or machined through the second plate 51*a* and threadingly engaging corresponding threaded features of the foot control switch 105.

Referring to FIG. 3, another embodiment of the disclosed bracket for a trolling motor controller (herein described as the "apparatus") 70 includes a similar second plate 51*a* and a means of positioning the foot control switch 105 as the previously described apparatus 10; however, the apparatus 70 includes attachment to the pedestal 102 via a (e.g., alternate) first plate 72. The first plate 72 includes an (e.g., alternate) aperture 73 having a fixed inner diameter that provides sliding installation onto the pedestal 102 (FIG. 1) envisioned to represent a maximum available diameter, thereby eliminating a need for a clamp (e.g., the first and second clamping ears 24*a*, 24*b*) (FIG. 2). The apparatus 70 further includes an optional flanged bushing 74 that is slidingly installed within the aperture 73 and having an inner diameter that allows installation of the first plate 72 upon the pedestal 102 of a lesser diameter.

Furthermore, it is envisioned that a plurality of flanged bushings 74 would be introduced having various inner diameters to slidingly fit pedestals 102 having corresponding diameters.

Those skilled in the art will recognize that other styles and configurations of the disclosed apparatus 10, 70 can be easily incorporated into the teachings of the present disclosure, and only particular configurations have been shown and described for purposes of clarity and disclosure and not by way of limitation of scope.

The disclosed embodiments of the apparatus 10, 70 can be utilized by the common user in a simple and effortless manner with little or no training. After initial purchase or acquisition of the apparatus 10, 70, it would be installed and utilized as illustrated in FIGS. 1-3.

Referring to FIGS. 1 and 2, one (1) embodiment of the disclosed method for installing and utilizing the apparatus 10 includes the following steps: 1). procuring the apparatus 10; 2). lifting and removing a boat seat 100 from the pedestal 102; 3). inserting the clamping aperture 22 of the mounting assembly 20 onto the pedestal 102 until resting upon the deck surface 110; 4). replacing the boat seat 100; 5). attaching the switch platform assembly 50 to the mounting assembly 20 by inserting respective slide plate 56 of the second plate extension 54 into the parallel channel features 32 of the first plate extension 31; 6). adjusting a position of the switch platform assembly 50 in a linear manner with respect to the mounting assembly 20 until obtaining a desired linear position; 7). securing the switch platform assembly 50 in position by inserting the positioning knob 34*a* through the first slotted hole 34*b* and threadingly engaging the positioning knob 34*a* into a corresponding positioning knob aperture 58; 8). rotating the positioning knob 34*a* until tightened; 9). lifting and removing the boat seat 100 from the pedestal 102; 10). attaching the apparatus 10 rotationally to the pedestal 102 by inserting the clamping aperture 22 upon the pedestal 102; 11). tightening the clamping knob 28*a* to close the clamping ears 24*a*, 24*b* until smooth rotation of the apparatus 10 in a three-hundred sixty degree (360°) circle around the pedestal 102 is obtained; 12). mounting the foot control switch 105 to a top surface of the second plate 51*a* of the switch platform assembly 50 by inserting fasteners 26 from below, through second slotted holes 52 of the second plate 51*a*, and threadingly engaging corresponding features upon the foot control switch 105; 13). activating the trolling motor and foot control switch 105 in a normal manner; 14). positioning a user either in a sitting position upon the boat seat 100 or in a standing position upon the deck surface 110; 15). participating in a fishing activity; and 16). freely rotating the apparatus 10 to a desired orientation around the pedestal 102 as required, enabling a user to access the foot control switch 105, based upon the user's position.

Accordingly, a user of the disclosed apparatus 10 can benefit from the rotating function of the apparatus 10 to continuously position the foot control switch 105 for use.

Due to the removable function of the apparatus 10 from the pedestal 102, the apparatus 10 may be easily removed for storage or for use upon another watercraft. One (1) embodiment of the disclosed method for removing the apparatus 10 includes the following steps: 1). removing the foot control switch 105 from the second plate 51*a* by loosening and removing the corresponding fasteners 26; 2). lifting the seat 100 up and out of the pedestal 102; 3). loosening the clamping knob 28*a* as needed to free the apparatus 10; and, 4). slidingly removing the apparatus 10 from the pedestal 102.

Referring to FIG. 3, one (1) embodiment of the disclosed method for installing and utilizing the apparatus 70 includes steps substantially similar to those described herein above for the apparatus 10. The apparatus 70 provides attachment to the pedestal 102 via the first plate 72. The first plate 72 includes an aperture 73 having a fixed inner diameter (e.g., representing a maximum available diameter) that provides sliding installation onto the pedestal 102, thereby eliminating a need for a clamping means of the apparatus 10.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A bracket for a foot control switch of a trolling motor, said bracket comprising:

a mounting assembly comprising:

a first plate comprising a first end configured to be removably connected to a substantially cylindrical pedestal of a boat seat and an opposed second end;

a first plate extension extending from said second end of said first plate; and a laterally opposed and spaced apart pair of channel features disposed at said first plate extension; and, a switching platform assembly connected to said mounting assembly, said switching platform assembly comprising:

a second plate configured for attachment of said foot control switch, said second plate comprising a first end and an opposed second end;

a second plate extension extending from said second end of said second plate; and, a laterally opposed and spaced apart pair of slide plates disposed at said second plate extension;

wherein said pair of channel features receives said pair of slide plates to removably connect said switching platform assembly to said mounting assembly.

2. The bracket of claim 1, wherein said mounting assembly is rotatable about said pedestal to position said switch platform assembly at a rotated position relative to said boat seat.

3. The bracket of claim 1, wherein said pair of slide plates is linearly adjustable within said pair of channel features to linearly position said switch platform assembly relative to said mounting assembly.

4. The bracket of claim 1, wherein said first end of said first plate comprises a cylindrical end comprising an aperture having a diameter suitably sized to receive said pedestal.

5. The bracket of claim 4, further comprising a flanged bushing comprising an inner diameter suitably sized to receive said pedestal and an outer diameter;

wherein said aperture has a diameter suitably sized to receive said outer diameter of said flanged bushing.

6. The bracket of claim 1, wherein:

said first plate extension comprises a slotted hole disposed through each of said pair of channel features;

said second plate extension comprises a positioning knob aperture disposed through each of said pair of slide plates;

said positioning knob aperture and said slotted hole align when each of said pair of channel features receives each of said pair of slide plates; and, said bracket further comprises a positioning knob engaging said positioning knob aperture through said slotted hole to fix said switch platform assembly at a selected linear position relative to said mounting assembly.

7. The bracket of claim 1, wherein said switching platform further comprises a plurality of holes disposed through said second plate and configured to receive a plurality of fasteners to connect said foot control switch to said switching platform assembly.

8. The bracket of claim 1, further comprising said control switch connected to said second plate of said switching platform assembly.

9. The bracket of claim 1, wherein said switching platform further comprises a second plate rim extending perpendicularly from a perimeter of said second plate and connected to said pair of slide plates.

10. The bracket of claim 1, wherein:

each of said pair of channel features extend perpendicularly from said first plate extension; and, each of said pair of slide plates extend perpendicularly from said second plate extension.

11. The bracket of claim 6, wherein:

said positioning knob aperture disposed through each of said slide plates is threaded; and, said positioning knob comprises a threaded shaft threadingly coupled to said positioning knob aperture.

* * * * *